US009279628B1

(12) United States Patent
Pollack

(10) Patent No.: US 9,279,628 B1
(45) Date of Patent: Mar. 8, 2016

(54) BOLT ACTION CONVERSION KITS AND METHODS

(71) Applicant: Chris Pollack, Carmel, NY (US)

(72) Inventor: Chris Pollack, Carmel, NY (US)

( * ) Notice: Subject to any disclaimer, the term of this patent is extended or adjusted under 35 U.S.C. 154(b) by 0 days.

(21) Appl. No.: 14/216,571

(22) Filed: Mar. 17, 2014

Related U.S. Application Data

(60) Provisional application No. 61/802,198, filed on Mar. 15, 2013.

(51) Int. Cl.
*F41A 3/12* (2006.01)
*F41A 11/02* (2006.01)
*F41A 9/00* (2006.01)

(52) U.S. Cl.
CPC ... *F41A 3/12* (2013.01); *F41A 9/00* (2013.01); *F41A 11/02* (2013.01)

(58) Field of Classification Search
CPC ..... F41A 7/02; F41A 35/00; F41A 3/12
USPC ..... 89/128, 1.4, 33.01
See application file for complete search history.

(56) References Cited

U.S. PATENT DOCUMENTS 875,209 A * 12/1907 Prinke ..... F41A 3/82 42/136
5,606,825 A * 3/1997 Olsen ..... F41A 3/72 42/51
6,508,158 B2 * 1/2003 Murello ..... F41A 35/06 89/1.42
8,176,827 B2 * 5/2012 Emde ..... F41A 19/34 89/1.4
8,464,453 B1 * 6/2013 Ubl ..... F41A 3/36 42/15
2003/0066226 A1 * 4/2003 Martin ..... 42/16
2010/0000396 A1 * 1/2010 Brown ..... 89/1.4
2010/0257768 A1 * 10/2010 Barrett ..... F41A 19/13 42/16
2011/0061523 A1 * 3/2011 Webb ..... 89/128
2011/0094136 A1 * 4/2011 Zimmerman ..... B21C 23/14 42/6
2011/0168009 A1 * 7/2011 Robb ..... F41A 3/54 89/194
2011/0271827 A1 * 11/2011 Larson ..... F41A 5/28 89/193
2012/0174451 A1 * 7/2012 Overstreet ..... F41A 35/06 42/16
2014/0311005 A1 * 10/2014 Tertin ..... F41A 3/20 42/16

* cited by examiner

*Primary Examiner* — Bret Hayes
(74) *Attorney, Agent, or Firm* — Brian R. Pollack; Day Pitney LLP

(57) ABSTRACT

The present disclosure relates to kits and associated methods for converting a semi-automatic firearm into a bolt single action firearm, as well as the converted firearm itself. The kit includes a housing (e.g. upper receiver) that accommodates a bolt carrier and a charging handle and a carrier key, if desired. The housing has ends which mount to the existing lower receiver of the semi-automatic firearm to convert the semi-automatic firearm into a manual bolt-action firearm.

15 Claims, 7 Drawing Sheets

A Typical semi automatic AR-15 upper receiver assembly

Charging Handle Operation for initial manual load

Gas Flow for Automatic Bolt Cycling

SECTION D-D
SCALE 1:1
Cotter Key
Upper Receiver
Gas Tube
Bolt Carrier
DETAIL E
SCALE 2 : 1.5

Gas Block
Gas Tube
DETAIL L
SCALE 2 : 1.5

Upper receiver assembly with the BR-15 conversion kit installed

Charging Handle Operation for manual loading
Gas port is blocked

SECTION B-B
SCALE 1 : 1.5
Upper Receiver
Carrier Key
Bolt Carrier

DETAIL C
SCALE 2 : 1.5

A Typical semi automatic AR-15 upper receiver assembly exploded view

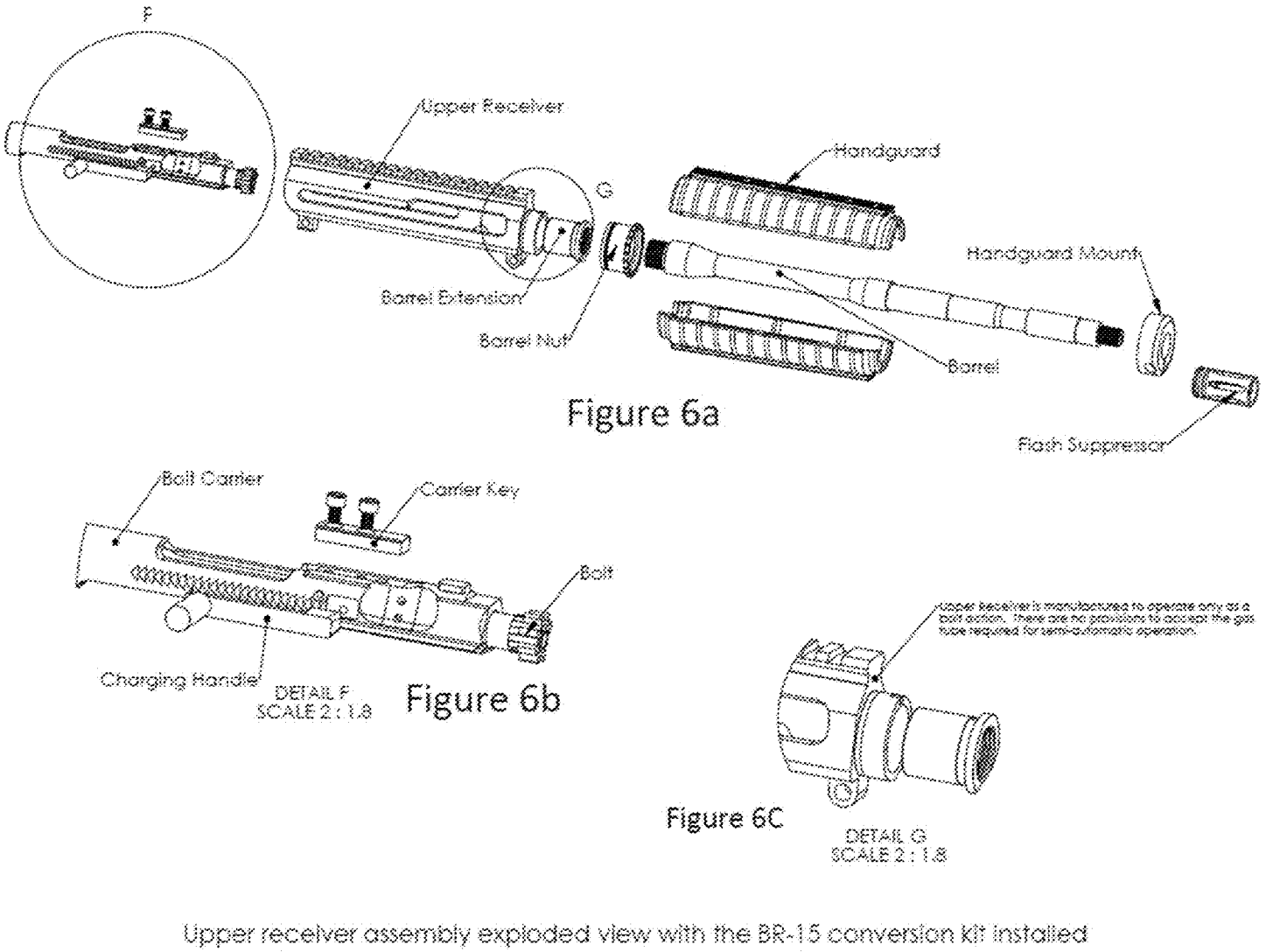
Upper receiver assembly exploded view with the BR-15 conversion kit installed

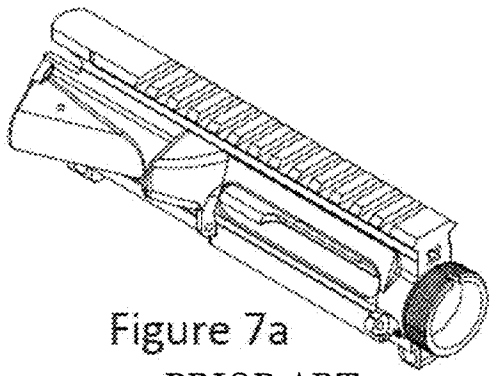
Figure 7a
PRIOR ART
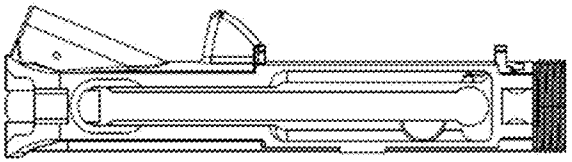
Figure 7b
PRIOR ART
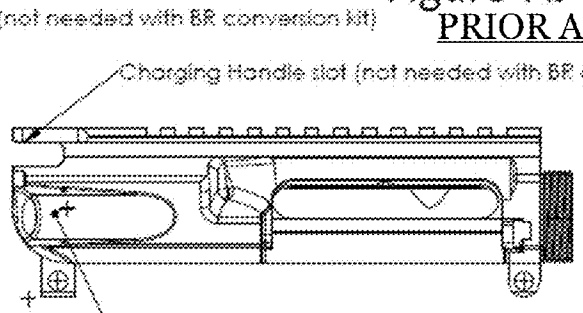
Figure 7c
PRIOR ART
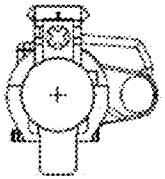
Figure 7d
PRIOR ART
Figure 7e
PRIOR ART
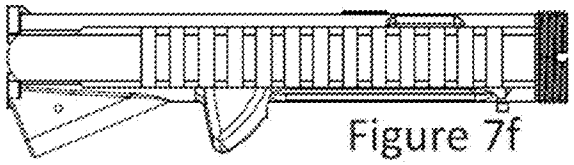
Figure 7f
PRIOR ART
A Typical AR-15 Upper Receiver Standard AR thread mount accepts any AR specific barrel nut.

Right hand charging handle slot

Standard mounting points for compatability with any AR specified lower receiver.

Optional left hand charging handle slot for left handed shooters.

8R-15 Upper Receiver

BOLT ACTION CONVERSION KITS AND METHODS

CROSS-REFERENCE TO RELATED APPLICATIONS

This application claims the benefit of priority to U.S. Provisional Patent Application 61/802,198 filed on Mar. 15, 2013, the disclosure of which is incorporated herein by reference in its entirety for any purpose whatsoever.

BACKGROUND

1. Field

The disclosed embodiments relate to firearms.

2. Description of Related Art

For firearm shooters, precision is paramount. Conventional semi-automatic rifles are not precise firearms even with a shooter having superior aim. When using the AR rifle as a semi-automatic firearm, the bolt begins cycle loading the next round prior to the bullet having fully left the barrel. This can cause unintended movement in a shooter's position which affects the aim of the shooter and ultimately the shooter's precision for a target. Moreover, quite commonly when shooting a semi-automatic firearm, it is a natural reaction to shoot more rounds than necessary because of the simplicity of having to just pull the trigger. The present application addresses these and other problems, as described herein.

SUMMARY

Advantages of the present disclosure will be set forth in and become apparent from the description that follows. Additional advantages of the disclosure will be realized and attained by the methods and systems particularly pointed out in the written description and claims hereof, as well as from the appended drawings.

Thus, in one embodiment, the disclosure provides a kit for converting a semi-automatic firearm into a bolt single action firearm. The kit includes a bolt action upper receiver, a bolt carrier configured to accommodate a single round of ammunition and a charging handle. The bolt action upper receiver is configured to be received by a pre-existing lower receiver of the semi-automatic firearm.

In some implementations, the charging handle can be located on the right-hand side or left-hand side of the firearm after the kit is installed, as desired, to accommodate right-handed or left-handed users. The kit is preferably configured to retain the use of original barrel components of the semi-automatic firearm. Preferably, the upper receiver does not include a gas port or gas tube.

The disclosure also provides a firearm converted using a kit as described herein. The firearm is preferably configured such that the charging handle from the kit as installed in the firearm is pulled back to load a round of ammunition after the kit is installed. Moreover, the firearm is preferably configured to permit the casing of the ammunition to be withdrawn and ejected when the charging handle is manually reverted back to its starting position. Preferably, a gas port in a barrel of the firearm is plugged as a result of installing the kit.

The disclosure also provides a method of converting a semi-automatic firearm into a bolt-action firearm. The method includes providing a bolt action upper receiver configured to be received by a pre-existing lower receiver of a semi-automatic firearm, a bolt carrier configured to accommodate a single round of ammunition and a charging handle. The method further includes installing the bolt action upper receiver, bolt carrier and the charging handle onto the pre-existing lower receiver of the semi-automatic firearm.

In further implementations, the disclosure provides a method for converting a semi-automatic firearm into a bolt single action firearm. The steps of the method include removing gas charging components of the semi-automatic firearm, removing an existing charging handle of the semi-automatic firearm, plugging a gas port in a barrel of the semi-automatic firearm, and inserting a housing having a bolt carrier, a carrier key and a charging handle to an existing lower receiver of the semi-automatic of the semi-automatic firearm to form a bolt action rifle.

Converting the assault rifle ("AR") platform semi-automatic rifle into a bolt action firearm through a bolt action conversion kit solves the problem of precision of semi-automatic rifles. The first key benefit for this conversion is to increase the accuracy of the rifle. Once the rifle is converted to a bolt action mechanism, movement is unnecessary until the shooter intends to load the next round.

Converting the assault rifle (AR) platform semi-automatic rifle into a bolt action firearm has an additional benefit. Installing the bolt action conversion kit will significantly increase muzzle velocity. Current semi-automatic rifle design uses gas energy emitted from the source of the shot to cycle the bolt assembly. This loss of energy is directly measured in a decrease of muzzle velocity. When muzzle velocity is lost, there is a decrease in the kinetic energy of the projectile which consequently reduces the range and accuracy of the firearm. Since no gas is needed in the operation of a bolt action firearm and no gas is to be expelled from the barrel for reloading purposes of a bolt action firearm, utilizing the beam rifle (BR-15) conversion kit will ensure the gun will retain and utilize all possible energy in the projectile. This increases the range and accuracy of the firearm.

Moreover, many regions and states are now regulating the ownership of semi-automatic firearms. By providing a conversion kit and related methods, the present application thus helps address the legal issues surrounding ownership of a semi-automatic firearm by converting a semi-automatic firearm into a bolt action firearm.

Quite commonly when shooting a semi-automatic firearm, it is a natural reaction to shoot more rounds than necessary because of the simplicity of having to just pull the trigger. The present application solves this problem since an additional benefit in the installation of the conversion kit is a potential reduction in shooting cost. With a converted bolt action firearm, the shooter is required to manually cycle the bolt before each round is fired by using the charging handle. When manually using a bolt action firearm, a person shooting tends to be more deliberate in their intentions given the additional time spent manually cycling each shot. Less rounds of ammunition fired means less money spent on rounds.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

BRIEF DESCRIPTION OF THE FIGURES

FIGS. 6*a*-6*c* are illustrative exploded views of the upper receiver assembly of a semi-automatic assault rifle with the bolt action conversion kit installed.

FIGS. 7*a*-7*f* are illustrative alternative views of the upper receiver of a semi-automatic assault rifle.

DETAILED DESCRIPTION

Figure 1:
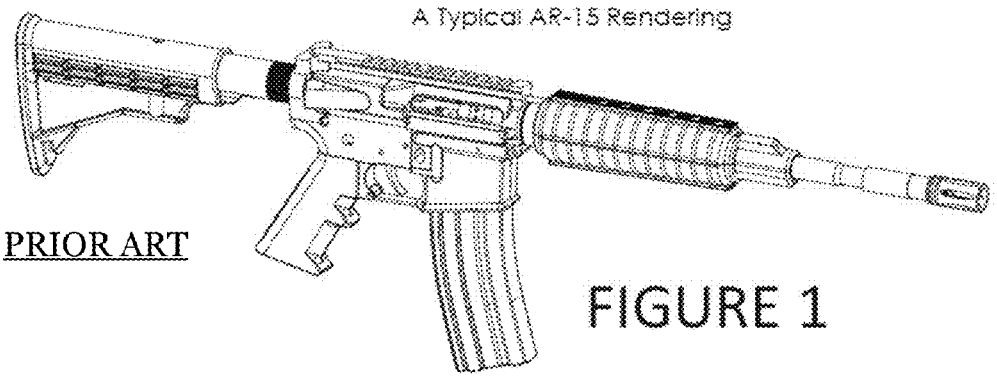
PRIOR ART FIGURE 1
FIG. 1 is an illustrative view of a semi-automatic assault rifle.
Figure 2:
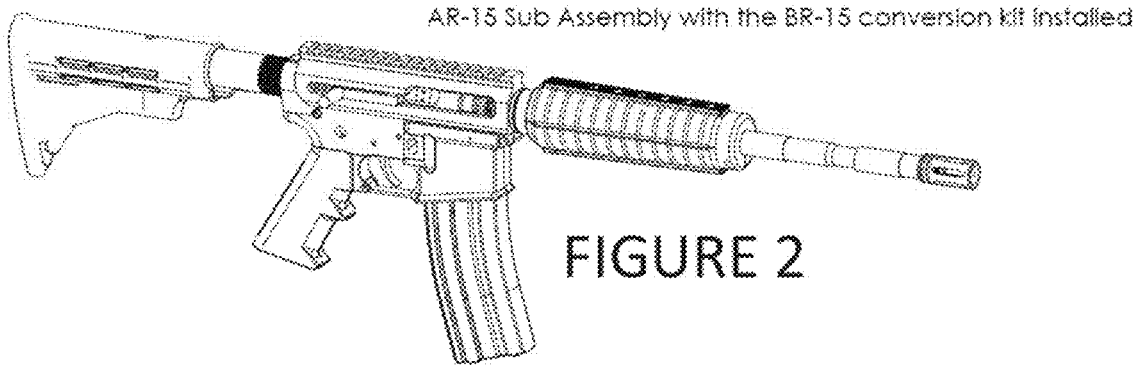
FIG. 2 is an illustrative view of the semi-automatic assault rifle with the bolt action conversion kit installed.

The disclosed embodiments of bolt action conversion kits allow for the converting of a typical semi-automatic assault rifle (AR-15) model (as shown in FIG. 1), Military Model 16 (M16), AR-10, Military Model 4 (MP4) or similar firearm to a bolt action rifle. FIG. 2 shows an example of an assault rifle once the conversion is complete. Once the conversion is complete, the rifle will only be usable as a bolt action rifle and no longer have the ability of auto loading its bullet cartridges. The design is based around the existing dimensions of the assault rifle platform and can install without any modification to the lower receiver assembly. However, in other embodiments, the conversion kit can be used to convert other semi-automatic weapons into bolt action single fire weapons.

Figures 3A, 3B, 3C, 3D, 3E:
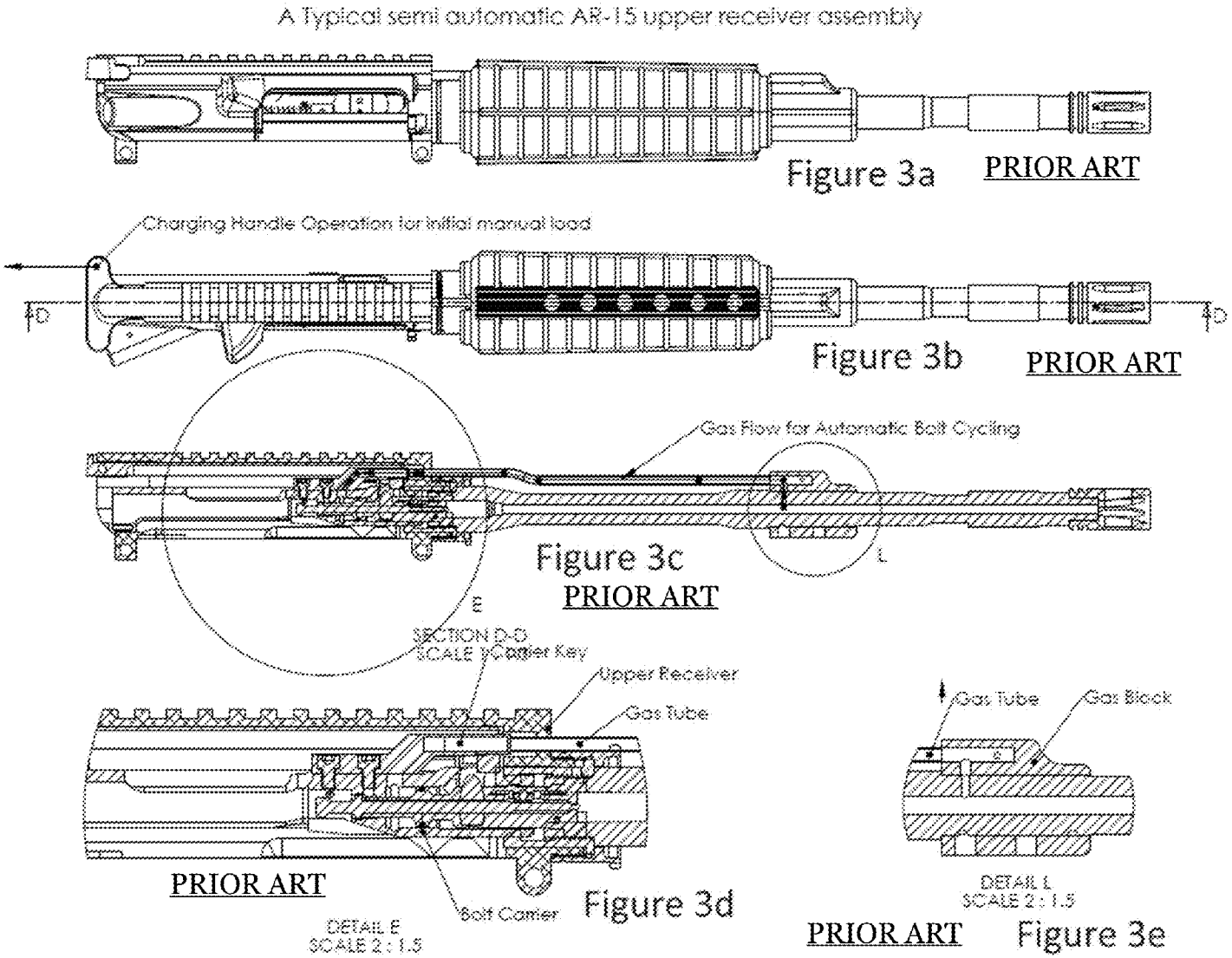
Figure 3a PRIOR ART
Figure 3b PRIOR ART
Figure 3c PRIOR ART
Figure 3d PRIOR ART
Figure 3e PRIOR ART
FIGS. 3*a*-3*e* are illustrative views of the upper receiver assembly of a semi-automatic assault rifle.

FIG. 3*a* illustrates a side view of a typical semi-automatic assault rifle (AR-15) upper receiver assembly. As shown in FIG. 3*b*, the existing upper receiver assembly of the AR-15 includes a charging handle which allows for an initial manual loading of ammunition. The charging handle allows a shooter to pull the bolt to the rear. The upper receiver assembly includes the main components needed to fire ammunition. FIG. 3*c* illustrates the gas flow needed for the automatic bolt cycling of the weapon. Gas is tapped from the barrel as the bullet moves past a gas port (designated as L in FIG. 3*c*) located above the rifle's front sight base. The gas flows into the port and down a gas tube (as shown in FIG. 3E), located above the barrel, which runs from the front sight base into the AR-15's upper receiver. Here, the gas tube protrudes into the carrier key (as shown in FIG. 3D) which accepts the gas and funnels it into the bolt carrier. The bolt carrier cycles back and forward between each shot. The bolt is propelled back by recoil or expanding gas and propelled forward by the recoil spring.

The bolt recoil causes movement in the shooter which decreases a shooter's accuracy and precision. When the bolt moves back, the extractor, an integral part of the bolt, pulls the spent casing from the chamber. When it moves forward, it strips a cartridge from the magazine and pushes it into the chamber. Once the case is clear of the chamber, the ejector kicks the case out of the weapon. As an example, in firing ten rounds from a semi-automatic firearm, the action would initially be cycled to load the first round and the trigger would need to be pulled ten times (once for each round fired). Semi-automatic weapons cause a shooter to fire multiple rounds unintentionally, thereby wasting ammunition. With installation of the bolt action conversion kit, ammunition is conserved.

Figures 4A, 4B, 4C, 4D:
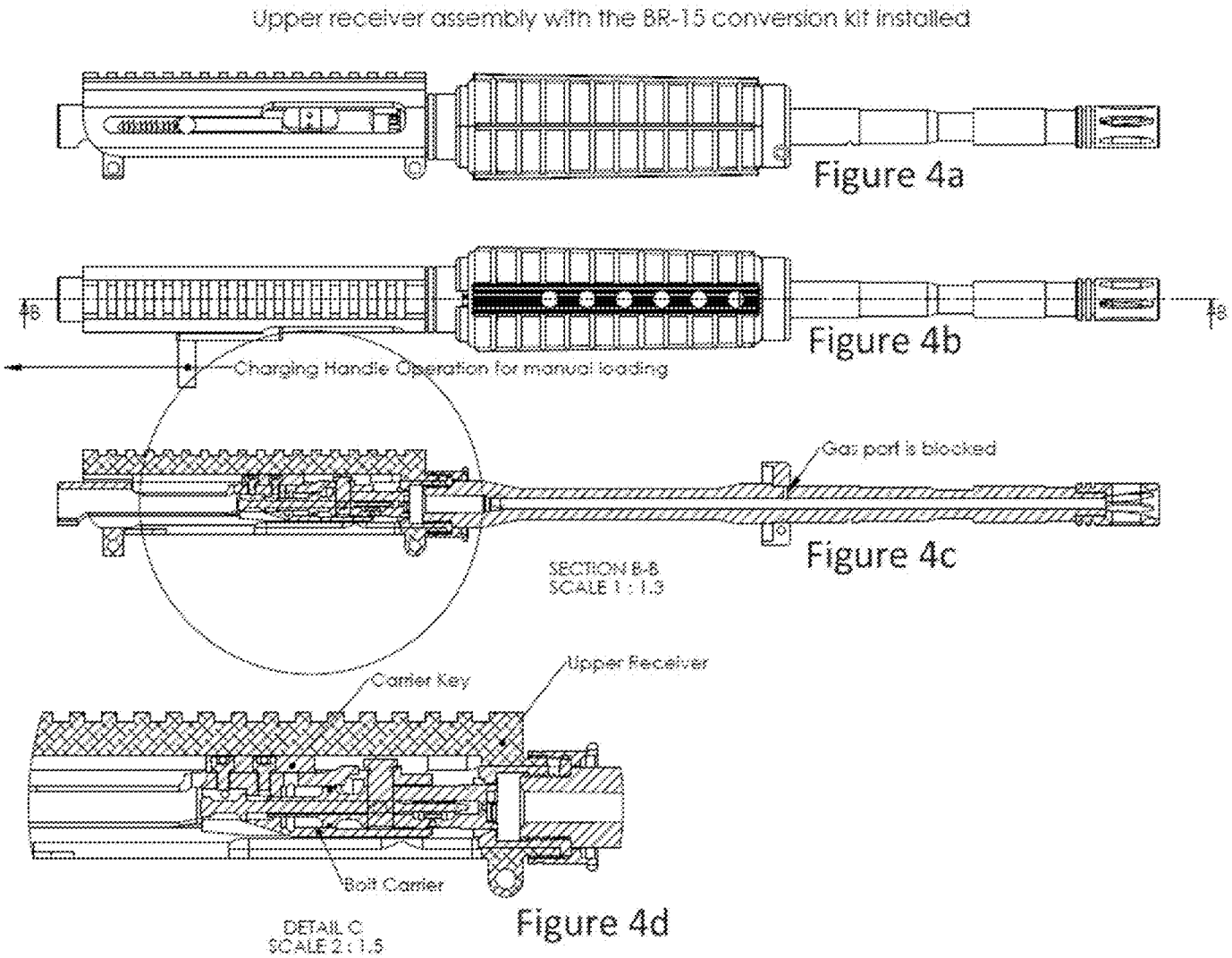
FIGS. 4*a*-4*d* are illustrative views of the upper receiver assembly of a semi-automatic assault rifle with the bolt action conversion kit installed.

FIG. 4*a* shows a side view of a semi-automatic assault rifle upper receiver assembly with the bolt action conversion kit installed. FIG. 4*b* shows the top view of the upper receiver assembly with the bolt action conversion kit which includes a new charging handle being attached for manual loading of ammunition. Since installation of the bolt action conversion kit utilizes the existing barrel assembly of the semi-automatic weapon, the conversion begins with the gas charging components of the semi-automatic weapon being removed as they are no longer needed. This includes plugging or blocking the gas port in the barrel as shown in FIG. 4*c*. FIG. 4*d* shows the new designed carrier key, bolt carrier and upper receiver.

Figure 5A:
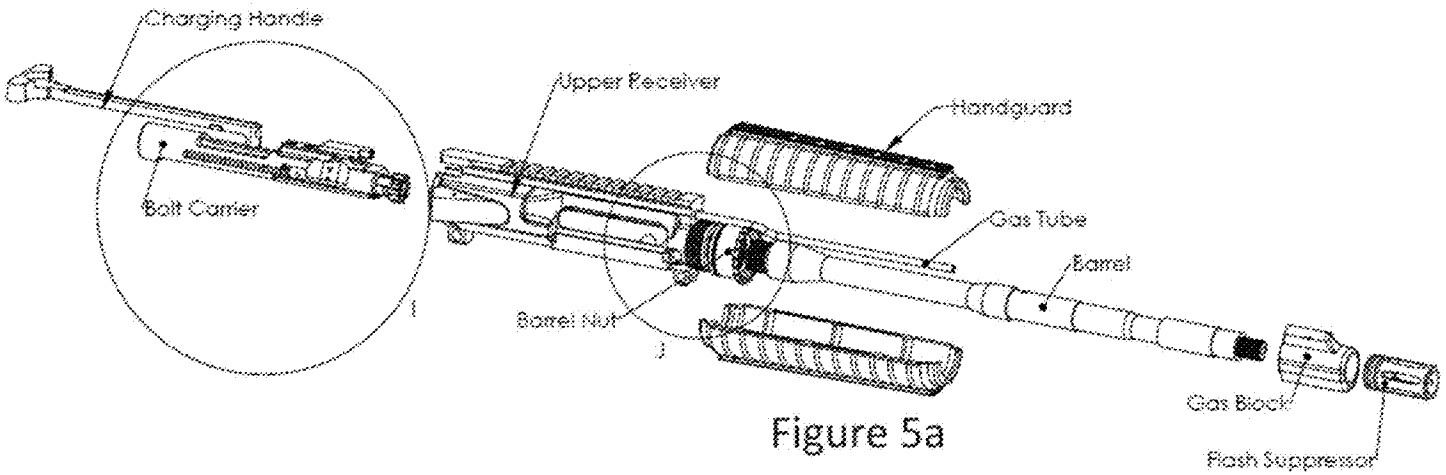
Figure 5a PRIOR ART
FIGS. 5*a*-5*c* are illustrative exploded views of the upper receiver assembly of a semi-automatic assault rifle.
Figure 5C:
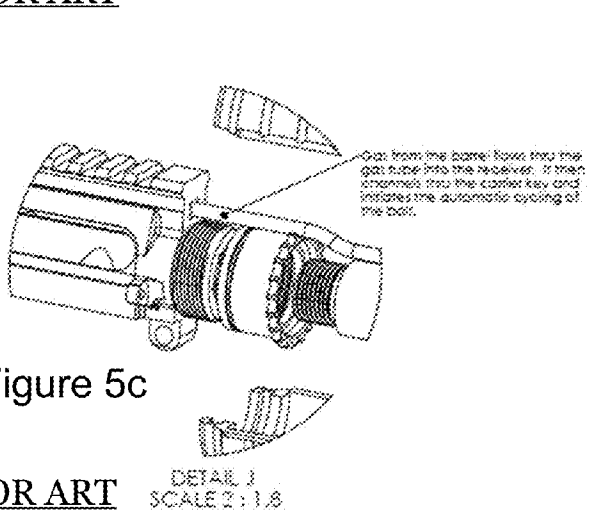
Figure 5c PRIOR ART
Figure 5B:
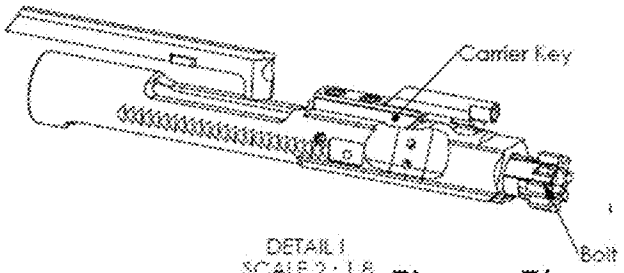
Figure 5b PRIOR ART

FIG. 5 shows a typical semi-automatic assault rifle (AR-15) upper receiver assembly parts in an exploded view. As described above, in FIG. 5*a*, gas from the barrel flows through the gas tube into the receiver. Gas is tapped from the barrel as the bullet moves past the gas port. The gas flows into the gas port and down the gas tube, located above the barrel, which runs from the front sight base into the AR-15's upper receiver. The gas tube protrudes into the carrier key (as shown in FIG. 5*b*) which accepts the gas and funnels it into the bolt carrier. This initiates the automatic cycling of the bolt carrier. The bolt carrier cycles back and forward between each shot. The bolt is propelled back by recoil or expanding gas and propelled forward by the recoil spring. The barrel nut, as shown in FIG. 5*a*, connects the upper receiver to the barrel of the assault rifle.

The conversion kit transforms such a semi-automatic weapon as discussed above into a bolt action or single action firearm. As shown in FIG. 6*a*, the gas tube and gas block are removed from the semi-automatic weapon as they are no longer needed. The existing gas port is blocked. As shown in FIG. 6*b*, the conversion kit assembly components include but are not limited to a bolt action upper receiver, bolt carrier and charging handle. The upper receiver is then inserted onto the existing lower receiver and retains the use of the original barrel components (as shown in FIG. 6*a*). However, the new charging handle is located on the right-hand side of the weapon where it is often located in bolt action firearms. The charging handle is then pulled back and moved forward, which loads the round. When the round is fired, the casing is withdrawn and ejected when the charging handle is manually reverted back to its starting position. In additional implementations, the bolt action conversion kit is configured to convert other semi-automatic weapons into bolt action weapons.

Figure 8A:
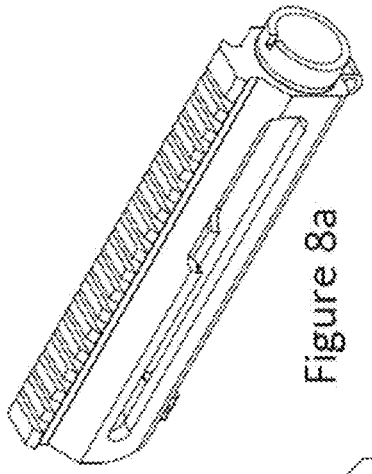
FIGS. 8*a*-8*g* are illustrative exploded views of the upper receiver of a semi-automatic assault rifle with the bolt action conversion kit installed.
Figure 8E:
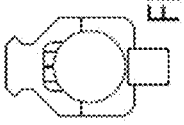
Figure 8B:
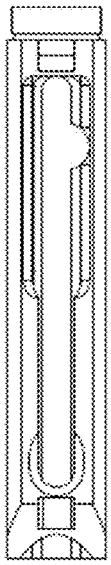
Figure 8D:
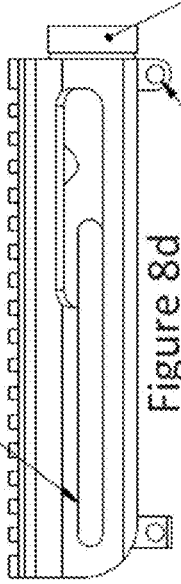
Figure 8F:
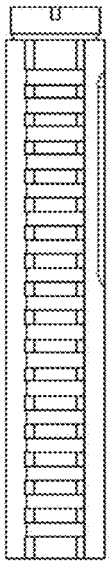
Figure 8G:
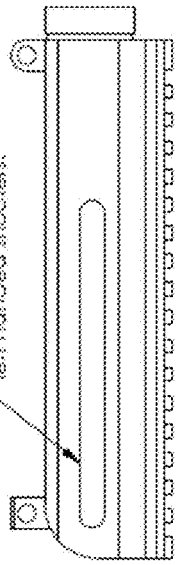
Figure 8C:
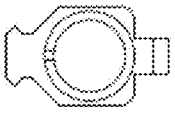

For further illustration, FIGS. 7*a*-7*f* shows an alternative view of the upper receiver of a typical semi-automatic assault rifle. FIG. 7*c* shows a top view of the gas tube port which is an unnecessary component once the bolt action conversion kit is installed. FIG. 7*d* shows the bottom view of the gas port tube. In addition, the charging handle slot and forward assist port, as shown in FIG. 7*d*, are also unnecessary components once the conversion kit is installed. FIGS. 8*a*-8*g* illustrates an alternative view of the upper receiver of the bolt action conversion kit. FIG. 8*c* and FIG. 8*e* show the upper receiver without the gas tube port. FIG. 8*d* shows the slot where the right-hand charging handle is inserted. The upper receiver of the conversion kit also includes standard mounting points where the existing lower receiver of the semi-automatic assault rifle can be attached to. Similarly, FIG. 8*d* shows the standard assault rifle thread mount which accommodates any assault rifle specific barrel nut which connects to the barrel of the assault rifle. In another embodiment, as shown in FIG. 8*g*, the upper receiver of the bolt action conversion kit includes a slot for a left-hand charging handle slot to be inserted for the benefit of left-handed shooters.

Various other components may be included and called upon for providing for aspects of the teachings herein. For example, additional materials, combinations of materials and/or omission of materials may be used to provide for added embodiments that are within the scope of the teachings herein. In the present application a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A kit for converting a semi-automatic firearm into a bolt single action firearm, the semi-automatic firearm having a native gas tube configured to pass through a distal face of an upper portion of a native upper receiver of the semi-automatic firearm, the kit comprising:

a) a modified bolt action upper receiver configured to be received by a pre-existing lower receiver of the semi-automatic firearm, the modified bolt action upper receiver having a proximal end, a distal end, a right side portion, a left side portion and an elongate upper wall section between the proximal end and distal end, the elongate upper wall section having a distal section that is a solid member at a location where the native gas tube entered the native upper receiver along a longitudinal axis of the firearm when the modified upper receiver is installed to prevent the native gas tube from being used to cycle the firearm during operation;

b) a modified bolt carrier configured to accommodate a single round of ammunition configured to reside within the modified upper receiver; and c) a modified charging handle configured to attach to the modified bolt carrier.

2. The kit of claim 1, wherein the charging handle can be mounted through the right or left side of the upper receiver to accommodate right or left handed shooters.

3. The kit of claim 2, wherein the modified upper receiver includes a charging handle slot defined through each of the right side portion and left side portion to accommodate use of a right handed or left handed charging handle, each charging handle slot defining a complete periphery defined by the material of the upper receiver.

4. A firearm converted from a semi-automatic firearm into a bolt single action firearm using the kit of claim 1.

5. The kit of claim 1, wherein the modified charging handle includes a distal portion connected to a side of the modified bolt carrier, an elongate body, and a proximal portion displaced along the length of the rifle proximally from the distal portion of the modified charging handle, the elongate body being of sufficient length to keep a right handed shooter's hand clear from a shell being ejected from the rifle when the modified bolt carrier is cycled manually.

6. The kit of claim 1, wherein a native gas port in a barrel of the firearm is plugged as a result of installing the kit.

7. The kit of claim 6, wherein the native gas port in the barrel of the firearm is blocked by installing a distal hand guard mount supplied with the kit on the barrel to block the native gas port.

8. A kit for converting a semi-automatic firearm into a bolt single action firearm, the kit comprising:

a) a modified bolt action upper receiver configured to be received by a pre-existing lower receiver of the semi-automatic firearm, the modified bolt action upper receiver having a proximal end, a distal end, a right side portion, a left side portion and an elongate upper wall section between the proximal end and distal end, the elongate upper wall section having a distal section that is a solid member at a location where a native gas tube entered a native upper receiver along a longitudinal axis of the firearm, when the modified upper receiver is installed, to prevent the native gas tube from being used to cycle the firearm during operation wherein the modified upper receiver includes a charging handle slot defined through each of the right side portion and left side portion to accommodate use of a right handed or left handed charging handle, each charging handle slot being defined by a complete perimeter including opposing longitudinal top and bottom edges joined by opposing end edges, each charging handle slot intersecting a horizontal plane that is parallel with a geometric centerline of the barrel of the firearm;

b) a modified bolt carrier configured to accommodate a single round of ammunition configured to reside within the modified upper receiver; and c) a modified charging handle configured to attach to the modified bolt carrier and extend through at least one of the charging handle slots.

9. A firearm converted from a semi-automatic firearm into a bolt single action firearm using the kit of claim 8.

10. The kit of claim 8, wherein a native gas port in a barrel of the firearm is plugged as a result of installing the kit.

11. The kit of claim 10, wherein the native gas port in the barrel of the firearm is blocked by installing a distal hand guard mount supplied with the kit on the barrel to block the native gas port.

12. A kit for converting a semi-automatic firearm into a bolt single action firearm, the kit comprising:

a) a modified bolt action upper receiver configured to be received by a pre-existing lower receiver of the semi-automatic firearm, the modified bolt action upper receiver having a proximal end, a distal end, a right side portion, a left side portion and an elongate upper wall section between the proximal end and distal end, the elongate upper wall section having a distal section that is a solid member at a location where a native gas tube entered a native upper receiver along a longitudinal axis of the firearm, when the modified upper receiver is installed, to prevent the native gas tube from being used to cycle the firearm during operation wherein the modified upper receiver includes a charging handle slot defined through at least one of the right side portion;

b) a modified bolt carrier configured to accommodate a single round of ammunition configured to reside within the modified upper receiver; and c) a modified charging handle configured to attach to the modified bolt carrier and extend through the charging handle slots, the modified charging handle including a distal portion connected to a side of the modified bolt carrier, an elongate body, and a proximal portion displaced along the length of the rifle proximally from the distal portion of the modified charging handle, the elongate body being of sufficient length to keep a shooter's right hand clear from a shell being ejected from the rifle through an opening defined through the modified bolt action upper receiver when the modified bolt carrier is cycled manually.

13. A firearm converted from a semi-automatic firearm into a bolt single action firearm using the kit of claim 12.

14. The kit of claim 12, wherein a native gas port in a barrel of the firearm is plugged as a result of installing the kit.

15. The kit of claim 14, wherein the native gas port in the barrel of the firearm is blocked by installing a distal hand guard mount supplied with the kit on the barrel to block the native gas port.

* * * * *